US008886062B2

(12) United States Patent
Shu

(10) Patent No.: US 8,886,062 B2
(45) Date of Patent: Nov. 11, 2014

(54) IMAGE FORMING APPARATUS AND IMAGE FORMING METHOD

(75) Inventor: Hyo Shu, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 212 days.

(21) Appl. No.: 13/468,377

(22) Filed: May 10, 2012

(65) Prior Publication Data

US 2012/0301160 A1 Nov. 29, 2012

(30) Foreign Application Priority Data

May 25, 2011 (JP) ..... 2011-117442
Apr. 27, 2012 (JP) ..... 2012-102171

(51) Int. Cl.
*G03G 15/08* (2006.01)
*G03G 9/087* (2006.01)

(52) U.S. Cl.
CPC ..... *G03G 15/0824* (2013.01); *G03G 9/08755* (2013.01); *G03G 9/08795* (2013.01); *G03G 2215/0607* (2013.01); *G03G 9/08782* (2013.01); *G03G 9/08797* (2013.01)
USPC ..... 399/30

(58) Field of Classification Search
CPC ..... G03G 15/0829; G03G 15/082
USPC ..... 399/30
See application file for complete search history.

(56) References Cited

U.S. PATENT DOCUMENTS 6,835,517 B2 12/2004 Kondo et al.
6,924,073 B2 8/2005 Higuchi et al.
6,934,484 B2 8/2005 Suzuki et al.
7,163,774 B2 1/2007 Shiraishi et al.
7,177,555 B2 2/2007 Shu et al.
7,183,029 B2 2/2007 Masuda et al.
7,217,485 B2 5/2007 Hasegawa et al.
7,522,857 B2 4/2009 Hasegawa et al.
7,901,861 B2 3/2011 Shitara et al.
7,985,518 B2 7/2011 Shu et al.
8,007,976 B2 8/2011 Sugiura et al.
8,012,659 B2 9/2011 Shu et al.
8,034,523 B2 10/2011 Hasegawa et al.
2006/0068306 A1 3/2006 Shu et al.
2006/0093943 A1 5/2006 Shu et al.
2006/0240350 A1 10/2006 Shu et al.
2007/0184377 A1* 8/2007 Shu et al. ..... 430/109.4
2007/0218396 A1* 9/2007 Tomita ..... 430/123.52
2010/0068644 A1 3/2010 Nakajima et al.

(Continued)

FOREIGN PATENT DOCUMENTS

JP 2005-338814 12/2005

*Primary Examiner* — Walter L Lindsay, Jr.
*Assistant Examiner* — Frederick Wenderoth
(74) *Attorney, Agent, or Firm* — Oblon, Spivak, McClelland, Maier & Neustadt, L.L.P.

(57) ABSTRACT

An image forming apparatus having a system speed of from 400 to 1,700 mm/sec, including a latent image bearer; an image developer developing the latent image with two-component developer including a toner and a carrier; a transferer, a toner concentration detector; a toner feeder; and a controller, wherein the toner comprises a release agent and a binder resin including a crystalline polyester resin and an amorphous resin, wherein a ratio (W/R) of a maximum rising peak height (W) of the crystalline polyester resin to a maximum rising peak height (R) of the amorphous resin, which are observed respective infrared absorption spectra when measured by an IR spectroscopy using a Fourier transform infrared spectroanalyzer, is from 0.22 to 0.55.

5 Claims, 4 Drawing Sheets

(56) References Cited

U.S. PATENT DOCUMENTS

| | | | | |
|---|---|---|---|---|
| 2010/0136471 | A1 | 6/2010 | Yamada et al. | |
| 2010/0158573 | A1 * | 6/2010 | Sheen | 399/254 |
| 2011/0002719 | A1 | 1/2011 | Shu et al. | |
| 2011/0091245 | A1 | 4/2011 | Shitara et al. | |
| 2011/0129773 | A1 | 6/2011 | Shu et al. | |
| 2011/0165508 | A1 | 7/2011 | Nakayama et al. | |
| 2011/0171572 | A1 * | 7/2011 | Matsumura et al. | 430/108.4 |
| 2011/0223532 | A1 | 9/2011 | Sugimoto et al. | |

* cited by examiner

IMAGE FORMING APPARATUS AND IMAGE FORMING METHOD

CROSS-REFERENCE TO RELATED APPLICATIONS

This patent application is based on and claims priority pursuant to 35 U.S.C. §119 to Japanese Patent Applications Nos. 2011-117442 and 2012-102171, filed on May 25, 2011 and Apr. 27, 2012, respectively in the Japanese Patent Office, the entire disclosure of which is hereby incorporated herein by reference.

FIELD OF THE INVENTION

The present invention relates to an image forming apparatus such as a copier, a printer, a facsimile or their complex machine and an image forming method forming an image with a two-component developer including a toner including at least a release agent and a binder resin and a carrier

BACKGROUND OF THE INVENTION

Image forming apparatuses using electrophotographic image forming process include an image forming apparatus developing with a two-component developer formed of a toner and a carrier which is a magnetic particulate material and an image forming apparatus developing with a one-component developer formed of only a toner without including a carrier. Japanese published unexamined application No. 2005-338814 discloses an image forming apparatus forming an image with a two-component developer, in which a toner and a carrier are stirred in an image developer such that the toner is charged and the charge toner is transferred to an electrostatic latent image formed on a latent image bearer such as a photoreceptor to form a toner image (visual image). When the toner image is formed, only the toner is fed from the image developer to the latent image bearer. Accordingly, the toner in the image developer decreases with formation of the toner images and a ratio of the toner to the carrier in the two-component developer (a toner density) changes. Therefore, in the image forming apparatus using the two-component developer, a toner is fed by a toner feeder into the image developer.

When a toner is fed into the image developer too much and an amount of the toner in the two-component developer excessively increases, an individual toner has less opportunity to contact a carrier and is not sufficiently charged. This causes foggy images, i.e., a toner scatters on parts besides an image on a recording material. To the contrary, a toner is too charged when not fed enough and the resultant image does not have enough density. Therefore, a conventional image forming apparatus includes a toner concentration sensor detecting a toner concentration in a two-component developer to control an amount of the toner fed thereto so as to have a target concentration of the two-component developer in an image developer.

It is known that a toner concentration required to produce images having a desired image density depends on an environmental conditions such as temperature and humidity of the developer and usage conditions thereof. Therefore, image density control to determine a target toner concentration suitable to the present conditions is made at a predetermined timing in many cases. In this image control, a toner pattern having a predetermined image density is formed on an image bearer, and the target toner concentration is amended, based on the result of the toner adherence detected by the image density sensor. Thus, the target toner concentration suitable to the present conditions is set and images having desired image density are stably produced.

Most of conventional toners include a binder resin which is a mother toner and a release agent such as a wax. However, when such a two-component developer including a toner including a release agent receives a mechanical stress such as stir and development process pressure, the toner agglutinates. Particularly, in a high-speed machine having a system speed, i.e., a surface traveling speed (process linear speed) of a latent image bearer of from 400 to 1,700 mm/sec, a stirrer stirs the two-component developer at high speed as well in an image developer, a toner receives a large mechanical stress and the toner more agglutinates.

When a toner more agglutinates in a two-component developer in an image developer, a difference between a toner concentration detected by the toner concentration and an actual toner concentration in the two-component developer becomes large and detection preciseness deteriorates. Therefore, the toner concentration is controlled based in an erroneous detection result, the actual toner concentration is excessively high or low, resulting in production of abnormal images. This problem is required to solve in such high-speed machines in which a toner tends to agglutinate.

Most conventional MFPs have a system linear speed not faster than 400 mm/sec, which is slow and a developer including a toner receives less mechanical stress in a developing unit. Therefore, a wax locally present on the surface of a toner does not noticeably agglutinate the toner. However, a digital printer used in on-demand printing in compliance with printing needs such as printmaking less, and volume less and varying documents is required to have a system linear speed not less than 400 mm/sec, and therefore a developer including a toner receives a large mechanical stress in a developing unit. A wax locally present on the surface of a toner agglutinates the toner and the developer deteriorates in fluidity, and a difference between a toner concentration detected by the toner concentration and an actual toner concentration in the two-component developer becomes larger, resulting in toner scattering.

Because of these reasons, a need exits for a high-speed image forming apparatus preventing production of abnormal images due to deterioration of toner concentration detection preciseness caused by toner agglutination.

SUMMARY OF THE INVENTION

Accordingly, one object of the present invention to provide a high-speed image forming apparatus preventing production of abnormal images due to deterioration of toner concentration detection preciseness caused by tonner agglutination.

Another object of the present invention to provide an image forming method using the image forming apparatus.

These objects and other objects of the present invention, either individually or collectively, have been satisfied by the discovery of an image forming apparatus having a system speed of from 400 to 1,700 mm/sec, comprising:

a latent image bearer configured to bear a latent image;

an image developer configured to develop the latent image with a two-component developer comprising a toner and a carrier to form a toner image; and a transferer configured to transfer the toner image onto a recording material, wherein the image forming apparatus further comprises:

a toner concentration detector configured to detect a toner concentration of the two-component developer in the image developer;

a toner feeder configured to feed a toner into the image developer; and a controller configured to control an amount of the toner fed by the toner feeder such that the toner concentration of the two-component developer in the image developer has a target toner concentration, and wherein the toner comprises a release agent and a binder resin comprising a crystalline polyester resin and an amorphous resin, wherein a ratio (W/R) of a maximum peak height (W) of the crystalline polyester resin to a maximum peak height (R) of the amorphous resin, which are observed respective infrared absorption spectra when measured by an IR spectroscopy (a total reflection method) using a Fourier transform infrared spectroanalyzer, is from 0.22 to 0.55.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a high-speed image forming apparatus preventing production of abnormal images due to deterioration of toner concentration detection preciseness caused by tonner agglutination.

More particularly, the present invention relates to an image forming apparatus having a system speed of from 400 to 1,700 mm/sec, comprising:

a latent image bearer configured to bear a latent image;

an image developer configured to develop the latent image with a two-component developer comprising a toner and a carrier to form a toner image; and a transferer configured to transfer the toner image onto a recording material, wherein the image forming apparatus further comprises:

a toner concentration detector configured to detect a toner concentration of the two-component developer in the image developer;

a toner feeder configured to feed a toner into the image developer; and a controller configured to control an amount of the toner fed by the toner feeder such that the toner concentration of the two-component developer in the image developer has a target toner concentration, and wherein the toner comprises a release agent and a binder resin comprising a crystalline polyester resin and an amorphous resin, wherein a ratio (W/R) of a maximum peak height (W) of the crystalline polyester resin to a maximum peak height (R) of the amorphous resin, which are observed respective infrared absorption spectra when measured by an IR spectroscopy (a total reflection method) using a Fourier transform infrared spectroanalyzer, is from 0.22 to 0.55.

In the present invention, a agglutination problem of a toner including at least a release agent and a binder resin is solved by the binder resin including a crystalline polyester resin and an amorphous resin, which have the ratio (W/R) of from 0.22 to 0.55. A toner satisfying this condition is difficult to have agglutination even when continuously receiving a mechanical stress. Its mechanism is not clarified, but is assumed as follows.

It is thought that a release agent such as a wax locally present on the surface of the toner causes agglutination of a toner continuously receiving a mechanical stress. In the present invention, it is assumed that the crystalline polyester resin used as a binder resin finely disperses the release agent and the specific crystalline polyester resin having the ratio (W/R) of from 0.22 to 0.55 is present on the surface of the toner prevents the release agent from being present thereon to uniformly disperse the release agent thereon. When the ratio (W/R) is less than 0.22, the local presence of the release agent on the surface of the toner is not sufficiently prevented and the agglutination of the toner as time passes is not sufficiently prevented. When greater than 0.55, the crystalline polyester resin increases and contaminate the surfaces of the latent image bearer and the carrier to deteriorate their primary functions.

Figure 1:
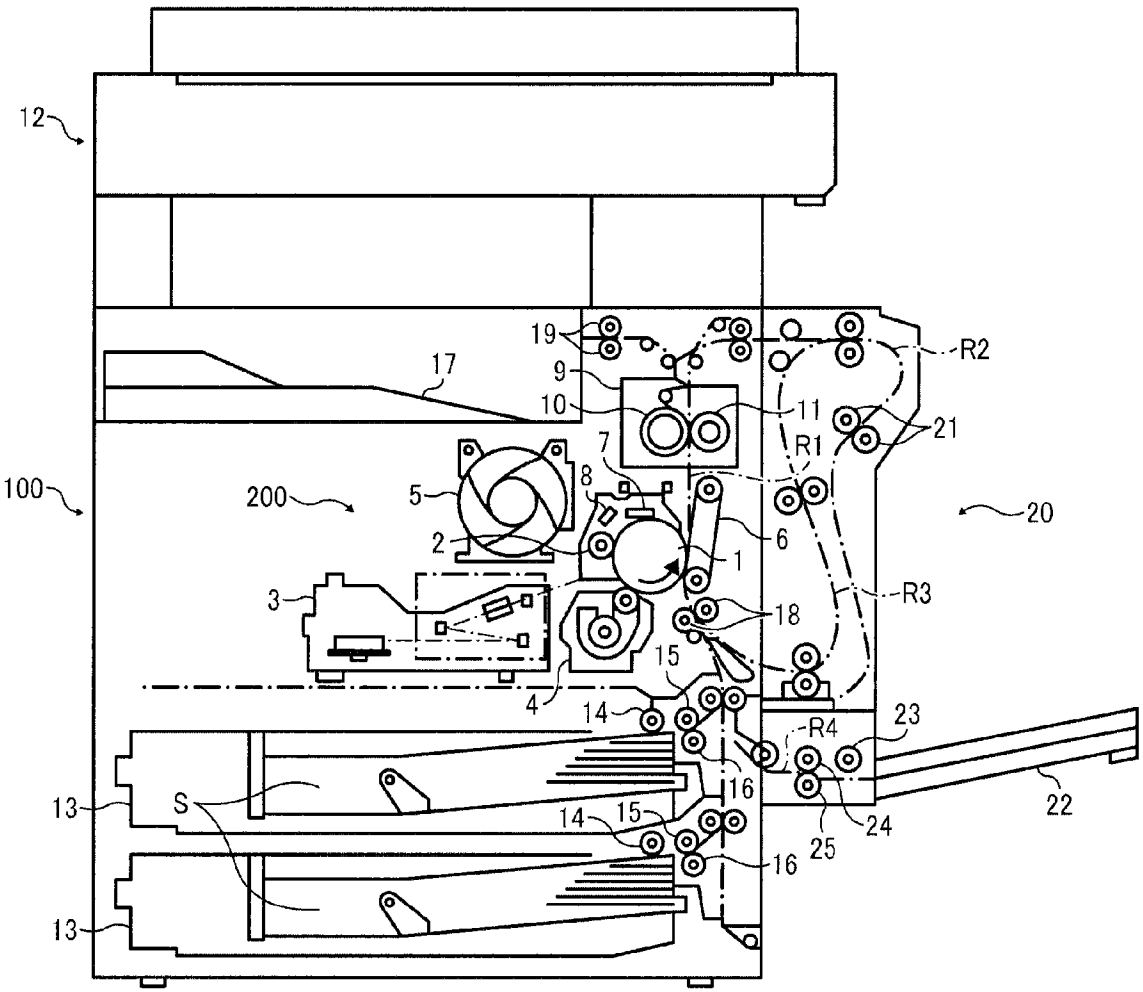
FIG. 1 is a schematic view illustrating an embodiment of the image forming apparatus of the present invention.

FIG. 1 is a schematic view illustrating an embodiment of the image forming apparatus of the present invention.

In FIG. 1, an image forming apparatus 100 includes an image forming unit 200. The image forming unit 200 includes a photoreceptor 1 as a latent image bearer bearing an electrostatic latent image, a charger 2 including a charging roller, an irradiator 3, an image developer 4, a toner feeder 5, a transferer 6, a cleaner 7 including a cleaning blade, a discharger 8 and a fixer 9. The fixer 9 includes a heat roller 10 and a pressure roller 11 contacting each other with pressure.

An image reader 12 is located above the image forming apparatus 100. Plural sheet cassettes 13 containing a sheet S as a recording material such as a paper and an OHP sheet are located below the image forming apparatus 100. Each of the sheet cassettes 13 includes a call roller 14, a feed roller 15 and a separation roller 16.

In the image forming apparatus 100, a sheet feed route R1 feeding the sheet S is formed from the sheet cassettes 13 to a stock table 17 above. In the sheet feed route R1, a pair of registration rollers 18 are located before the photoreceptor 1 from the sheet cassettes 13. A pair of discharge rollers 19 are located at an exit of the sheet feed route R1.

The image forming apparatus of the present invention includes a sheet reverser 20 on the right in FIG. 1. The sheet reverser 20 has a reverse route R2 branched before the exit of the sheet feed route R1. A pair of switchback rollers 21 rotating forward and reverse are located in the reverse route R2. The reverse route R2 joins the sheet feed route R1 through a refeed route R3.

A manual tray 22 is openably and closably located below the sheet reverser 20. A manual feed route R4 guiding a sheet on the manual tray 22 to the sheet feed route R1 is located. A call roller 23, a feed roller 24 and a separation roller 25 are located at an entrance of the manual feed route R4.

Figure 2:
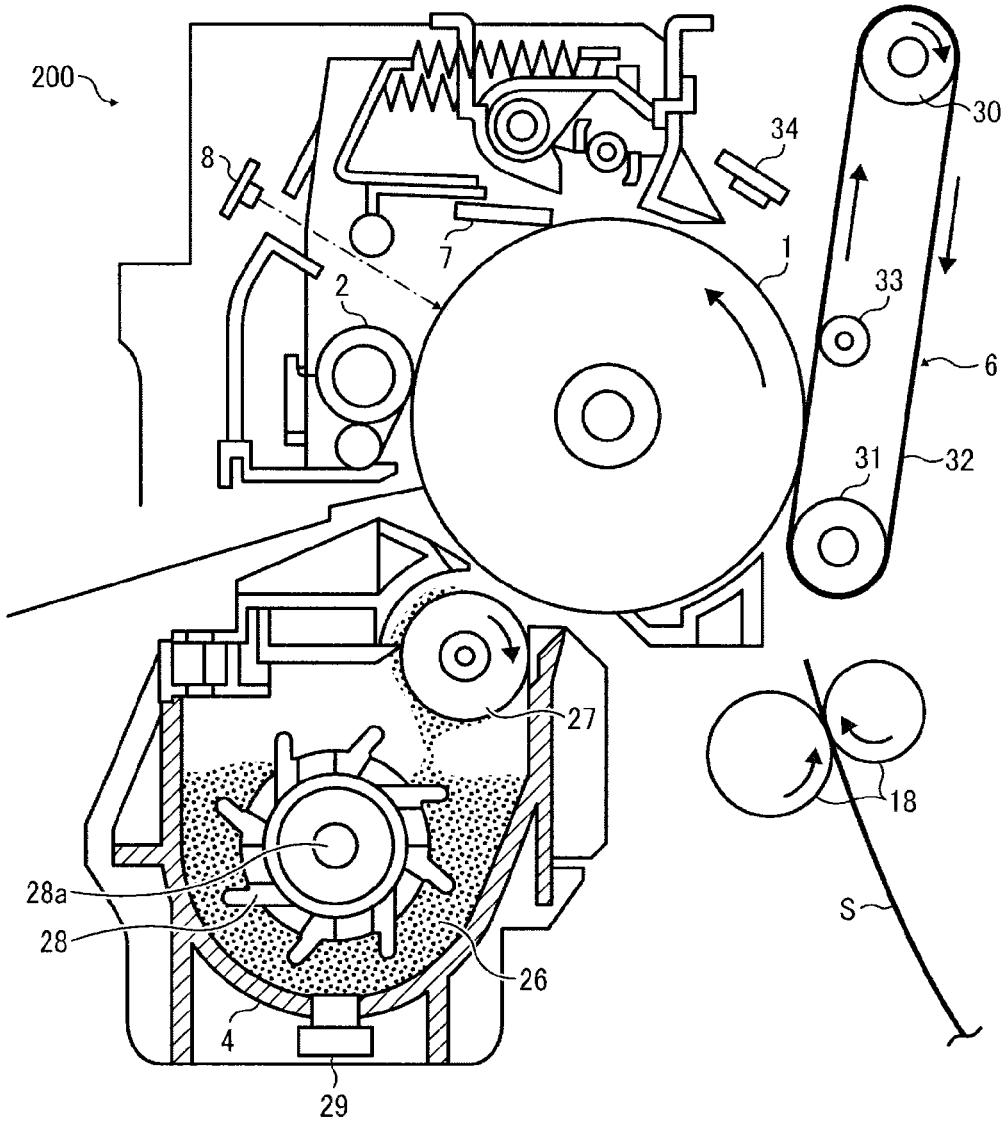
FIG. 2 is a partially amplified view illustrating a part of the image forming apparatus in FIG. 1.

FIG. 2 is a partially amplified view illustrating a part of the image forming unit 200.

In FIG. 2, the image developer 4 contains a two-component developer 26 (hereinafter referred to as a "developer"). The developer 26 includes a carrier which is a particulate magnetic material and a non-magnetic toner. The image developer 4 includes a developing sleeve 27 as a developer bearer bearing the developer 26 and a stirring member 28 stirring the developer 26. The developing sleeve 27 includes an unillustrated magnet roller having plural magnets or magnetic poles. The stirring member 28 is rotatably located around an axis 28*a*.

The image developer 4 includes a toner concentration sensor 29 as a toner concentration detector. In the present invention, a magnetic permeability sensor is used as the toner concentration sensor 29. The magnetic permeability sensor detects a magnetic permeability of the developer 26 to detect a ratio of a toner in the developer, i.e. a toner concentration. Other devices capable of detecting a concentration of the developer besides the magnetic permeability sensor can also be used.

In FIG. 2, the transferer 6 includes an endless transfer belt 32 extended by a drive roller 30 and a driven roller 31 with tension. The transfer belt 32 is located contactable to and separable from the photoreceptor 1 by an unillustrated contact and separation mechanism. A bias roller 33 as a voltage application member is located at an inner circumferential surface of the transfer belt 32 near a position where an outer circumferential surface thereof contacts the surface of the photoreceptor 1.

In the present invention, a toner pattern for image density adjustment is formed on the surface of the photoreceptor 1. The toner pattern is formed on the surface of the photoreceptor 1 as an ordinary image is formed thereon. In FIG. 2, a pattern image density sensor 34 as a toner adherence amount detector detecting a toner adherence amount (toner pattern image density) of a toner pattern on the photoreceptor 1 is located on the left side of the transferer 6. The pattern image density sensor 34 includes a photosensor including a light emitting element formed of infrared light emitting LED and a light receiving element formed of a phototransistor receiving reflected light from the light emitting element to produce an electrical signal according to the light intensity. The pattern image density sensor 34 is not limited to this if other devices capable of detecting the adherence amount of a toner pattern on the photoreceptor 1 are available.

Figure 3:
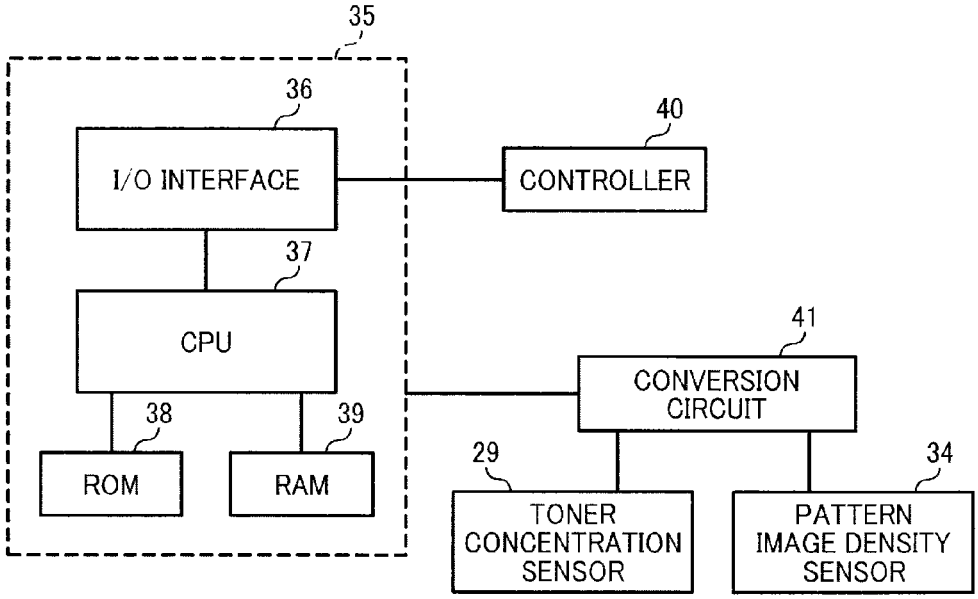
FIG. 3 is a block diagram of the image forming apparatus in FIG. 1.

FIG. 3 is a block diagram of a controller 35 controlling a total operation of the image forming apparatus of the present invention.

In FIG. 3, the controller 35 is formed of a computer including an I/O interface 36, a CPU 37, a ROM 38 and Ram 39. Numeral 40 in FIG. 3 is an operation unit including an operation display and various setting keys. The toner concentration sensor 29 and the pattern image density sensor 34 are connected to the controller 35 through an A/D conversion circuit 41 converting an analog signal into a digital signal.

An operation of the image forming apparatus of the present invention is explained, referring to FIGS. 1 and 2.

First, the image reader 12 reads a document. At the same time, the photoreceptor 1 is rotated by an unillustrated drive motor and the surface thereof is charged by the charger 2 to have a uniform high potential. Next, according to the document content (image information) read by the image reader 12, the irradiator 3 irradiates the surface of the photoreceptor 1 with a laser beam. The potential of the part thereof irradiated with the laser beam decreases to form an electrostatic latent image on the surface thereof. A developer borne on the developing sleeve 27 in the image developer 4 is transferred to a position facing the photoreceptor 1, and a toner in the developer adheres to the electrostatic latent image on the surface thereof. Thus, a toner image is formed thereon.

Meanwhile, the call roller 14 feeds sheets S contained in the sheet cassette 13. The sheets S are separated by the feed roller 15 and the separation roller 16 into one by one, and the separated sheet S is guided to the sheet feed route R1. The separated sheet S guided to the sheet feed route R1 is stopped by the pair of registration rollers 18. When the sheet S is manually fed, the manual tray 22 is opened and the sheet S is located thereon. The call roller 23, the feed roller 24 and the separation roller 25 separate the sheets S one by one, and the separated sheet S is fed to the manual feed route R4. The sheet S fed to the manual feed route R4 is guided to the sheet feed route R1 and stopped by the pair of registration rollers 18.

Then, the pair of registration rollers 18 are driven again to feed the sheet S to a contact part (transfer position) between the photoreceptor 1 and the transfer belt 32 to receive the toner image on the photoreceptor 1. The transfer belt 32 is applied with a voltage having a polarity reverse to that of a toner through a bias roller 33 by an unillustrated electric source to form a transfer electric field between the photoreceptor 1 and the transfer belt 32. The transfer electric field transfers the toner image onto the sheet S fed to the contact part between the photoreceptor 1 and the transfer belt 32. After the toner image is transferred, a toner and a potential remaining on the surface of the photoreceptor 1 is removed by the cleaner 7 and the discharger 8, respectively.

The sheet S the toner image is transferred on is fed to the fixer 9, and the toner image is fixed on the sheet S while passing the heat roller 10 and the pressure roller 11. Then, the sheet S is discharged on the stock table 17 by the pair of discharge rollers 19.

When an image is formed on both sides of the sheet S, after a toner image is fixed on one side of the sheet S, the sheet S is guided to the reverse route R2 instead of being discharged on the stock table 17. The sheet S fed to the reverse route R2 is fed reverse by the pair of switchback rollers 21 to the refeed route R3. This is typically called a switchback operation reversing the front and back of the sheet S. Then, the sheet S is guided to the sheet feed route R1 again and a toner image is transferred onto the backside of the sheet S.

Next, a toner feed control method of the present invention is explained.

The toner concentration is preferably detected by the toner concentration sensor 29 when a developer is stirred in the image developer 4. The toner concentration sensor 29 preferably detects a toner concentration at an interval as short as possible. In the present invention, the toner concentration sensor 29 detects the toner concentration every time an image is formed. Meanwhile, it is not preferable that the toner pattern is so frequently detected by the pattern image density sensor 34 because regular image formation is interrupted every time. In the present invention, the pattern image density sensor 34 detects the toner pattern every 100 image formations. The numbers of detection times of the toner concentration sensor 29 and the pattern image density sensor 34 are not limited to the above, and can properly be determined.

When the toner concentration sensor 29 detects the toner concentration of a developer in the image developer 4, the detection result (output voltage) Vt is transmitted to the controller 35. The controller 35 compares the output voltage Vt with a target value (reference voltage) Vt ref corresponding to a target toner concentration. When the output voltage Vt is not less than Vt ref, the toner feeder 5 is driven to feed a toner into the image developer 4. When the output voltage Vt is less than Vt ref, the toner feeder 5 is stopped to stop feeding a toner into the image developer 4.

A toner pattern is formed on the photoreceptor 1 every 100 image formations, and the pattern image density sensor 34 detects a toner adherence amount of the toner pattern. Then, the transfer belt 32 is separately located from the photoreceptor 1 such that the toner pattern formed thereon is not transferred onto the transfer belt 32 of the transferer 6. The detection result (output voltage) Vp of the toner pattern detected by the pattern image density sensor 34 is transmitted to the controller 35. The controller 35 compares the output voltage Vp with a target value (reference voltage) Vp ref corresponding to a target toner adherence amount.

The toner pattern formed on the photoreceptor 1 may be transferred onto transfer belt 32 of the transferer 6 to detect the toner adherence amount of the toner pattern thereon.

When the output voltage Vp is not less than the reference voltage Vp ref, the target value (reference voltage) Vt ref of the toner concentration sensor 29 is amended to be higher. The higher reference voltage Vt ref of the toner concentration sensor 29 rises a threshold whether a toner is fed into the image developer 4, and the toner concentration lowers as a result. When the output voltage Vp is less than the reference voltage Vp ref, the target value (reference voltage) Vt ref of the toner concentration sensor 29 is amended to be lower. The lower reference voltage Vt ref of the toner concentration sensor 29 lowers a threshold whether a toner is fed into the image developer 4, and the toner concentration rises as a result. Such a combination of the toner concentration sensor 29 and the pattern image density sensor 34 stably maintains proper image density.

Hereinafter, the toner for use in the present invention is explained.

Specific examples of the amorphous resins as a toner binder resin include styrene resins such as styrene, α-methylstyrene, chlorostyrene, styrene-propylene copolymers, styrene-butadiene copolymers, styrene-vinylchloride copolymers, styrene-vinylacetate copolymers, styrene-maleic acid copolymers, styrene-ester acrylate copolymers, styrene-α-methylchloroacrylate copolymers and styrene-acrylonitrile-ester acrylate copolymers; polyester resins; vinylchloride resins; rosin-modified maleic acid resins; phenol resins; epoxy resins; polyethylene resins; polypropylene resins; ionomer resins; polyurethane resins; silicone resins; ketone resins; xylene resins; petroleum resins; hydrogenated petroleum resins, etc. Among these resins, amorphous polyester resins are preferably used in the present invention.

The toner binder resin in the present invention includes an amorphous polyester resin and a crystalline polyester resin. A mixing weight ratio thereof is preferably from 1:99 to 30:70, and more preferably from 1:99 to 15:85. When the ratio of the crystalline polyester resin is too high, the photoreceptor tends to have toner filming. When too low, the toner fixability tends to deteriorate.

Whether a polyester resin has crystallinity depends on whether an X-ray diffraction pattern drawn by a powder X-ray diffractometer has a peak. The crystalline polyester resin has at least one diffraction peak in the diffraction pattern at 2θ in a range of from 20 to 25°, and preferably a diffraction peak at least at 2θ in a range of from (i) 19 to 20°, (ii) 21 to 22°, (iii) 23 to 25° and (iv) 29 to 31°. The amorphous polyester resin does not have a crystal peak at 2θ. The powder X-ray diffraction is measured by RINT1100 from Rigaku Corp. using a wide-angle goniometer under the following conditions:

X-ray tube bulb: Cu

Tube voltage: 50 kV

Tube current: 30 mA.

The polyester resin is not particularly limited, but preferably an aliphatic polyester resin including an ester bond having the following formula (1) in the molecular main chain in an amount not less than 60% by mol.

$$-\!\!\left[O-CO-CR_1=CR_2-CO-O-(CH_2)_n\right]\!\!- \quad (1)$$

wherein $R_1$ and $R_2$ represents a hydrogen atom or a hydrocarbon group having 1 to 20 carbon atoms; and n is a positive integer.

In the formula (1), R represents a straight chain unsaturated aliphatic dicarboxylic residue having 2 to 20 carbon atoms, and preferably a straight chain unsaturated aliphatic group having 2 to 4 carbon atoms. n is an integer of from 2 to 20, and preferably from 2 to 6. The structure having the formula (1) can be identified by solid$^{13}$C-NMR method. Specific examples of the straight chain unsaturated aliphatic group include straight chain unsaturated aliphatic groups from straight chain unsaturated aliphatic dicarboxylic acids such as a maleic acid, a fumaric acid, a 1,3-n-propendicarboxylic acid and a 1,4-n-butendicarboxylic acid.

In the formula (1), $(CH_2)_n$, represents a straight chain aliphatic diol residue. Specific examples thereof include straight chain aliphatic diol residues induced from straight chain aliphatic diols such as ethyleneglycol, 1,3-propyleneglycol, 1,4-butanediol and 1,6-hexanediol. The polyester resin using the straight chain unsaturated aliphatic dicarboxylic acid as an acidic component forms a crystal structure easier than using an aromatic dicarboxylic acid.

The polyester resin can be prepared by a typical method of polycondensing (i) a polycarboxylic acid formed of the straight-chain unsaturated aliphatic dicarboxylic acid or its reactive derivatives such as an acid anhydride, a lower alkyl ester having 1 to 4 carbon atoms and an acid halide and (ii) a polyol formed of the straight-chain aliphatic diol. A small amount of other polycarboxylic acids can optionally be added to (i). The other polycarboxylic acids include (1) an unsaturated aliphatic dicarboxylic acid having a branched chain, (2) saturated aliphatic polycarboxylic acids such as a saturated aliphatic dicarboxylic acid and a saturated aliphatic tricarboxylic acid, (3) aromatic polycarboxylic acids such as an aromatic dicarboxylic acid and an aromatic tricarboxylic acid, etc. The content of the other polycarboxylic acids is typically not greater than 30% by mol, and preferably not greater than 10% by mol.

Specific examples of the other polycarboxylic acids include dicarboxylic acids such as a malonic acid, a succinic acid, a glutaric acid, an adipic cid, a suberic acid, a sebacic acid, a citraconic acid, a phthalic acid, an isophthalic acid and terephthalic acid; and tri- or more valent polycarboxylic acids such as a 1,2,4-benzenetricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, 1,3-dicarboxyl-2-methyl-methylenecarboxypropane, tetra(methylenecarboxyl)methane and a 1,2,7,8-octantetracarboxylic acid.

A small amount of other polyols such as aliphatic branched-chain diols, cyclic diols and tri- or more valent polyols can optionally be added to (ii). The content of the other polyols is typically not greater than 30% by mol, and preferably not greater than 10% by mol based on total mol of the polyols within the limits wherein the resultant polyester resin has crystallinity. Specific examples of the other polyols include 1,4-bis(hydroxymethyl)cyclohexane, polyethyleneglycol, adducts of bisphenol A with ethyleneoxide, adducts of bisphenol A with propyleneoxide, glycerin, etc.

The polyester resin preferably has a sharp molecular weight distribution and low molecular weight in terms of low-temperature fixability of the resultant toner. The polyester resin (A) preferably has a weight-average molecular weight (Mw) of from 5,500 to 6,500, a number-average molecular weight (Mn) of form 1,300 to 1,500 and a ratio (Mw/Mn) of from 2 to 5 in a molecular weight distribution by a GPC of its components soluble with o-dichlorobenzene, having an x-axis representing log (M) and a y-axis representing % by weight. The polyester resin (A) preferably has a peak in a scope of from 3.5 to 4.0 (% by weight) and a half width of the peak not greater than 1.5 therein.

The polyester resin typically has a glass transition temperature (Tg) of from 80 to 130° C., and preferably from 80 to 125° C., and a softening point $T(F_{1/2})$ of from 80 to 130° C., and preferably from 80 to 125° C. so as not to deteriorate thermostable preservability of the resultant toner. When Tg and $T(F_{1/2})$ are higher than 130° C., the low-temperature fixability of the resultant toner deteriorate because the minimum fixable temperature rises.

The crystalline polyester resin preferably has an acid value of not less than 20 mg KOH/g in terms of affinity with papers such that the resultant toner has desired low-temperature fixability, and not greater than 45 mg KOH/g to improve hot offset resistance of the resultant toner.

The crystalline polyester resin preferably has a hydroxyl value of from 5 to 50 mg KOH/g, and more preferably from 5 to 25 mg KOH/g such that the resultant toner has desired low-temperature fixability and good chargeability. When less than 5 mg KOH/g, the resultant toner is poorly charged to produce abnormal images. When greater than 50 mg KOH/g, the resultant toner deteriorates in environmental variation.

Known release agent can be used in the toner of the present invention. Specific examples of the release agent include low-molecular-weight polyolefin waxes such as low-molecular-weight polyethylene and low-molecular-weight polypropylene; carbon hydride waxes such as a Fischer-Tropsch wax; natural waxes such as a bees wax, a carnauba wax, a candelilla wax, a rice wax, a Montan wax; petroleum waxes such as a paraffin wax and a microcrystalline wax; higher fatty acids such as a stearic acid, a palmitic acid, a myristic acid and their metallic salts; higher fatty acid amide; synthetic ester waxes and their modified waxes. These waxes can be used alone or in combination. Among these waxes, the carnauba wax, polyethylene wax and synthetic ester waxes are preferably used.

The toner of the present invention preferably includes the release agent in an amount of from 2 to 15% by weight. When the amount is less than 2% by weight, the resultant toner does not have sufficient offset resistance. When greater than 15%, transferability and durability thereof deteriorate.

Known pigments and dyes capable of preparing a yellow, a magenta, a cyan and a black toner can be used as the colorant.

Specific examples of the yellow pigments include cadmium yellow, Pigment Yellow 155, benzimidazolone, Mineral Fast Yellow, Nickel Titan Yellow, naples yellow, Naphthol Yellow S, Hansa Yellow G, Hansa Yellow 10G, Benzidine Yellow GR, Quinoline Yellow Lake, Permanent Yellow NCG, Tartrazine Lake, etc.

Specific examples of the orange color pigments include Molybdenum Orange, Permanent Orange GTR, Pyrazolone Orange, Vulcan Orange G, Indanthrene Brilliant Orange GK, etc.

Specific examples of the red pigments include red iron oxide, quinacridone red, cadmium red, Permanent Red 4R, Lithol Red, Pyrazolone Red, Watching Red calcium salts, Lake Red D, Brilliant Carmine 6B, Eosine Lake, Rhodamine Lake B, Alizarine Lake, Brilliant Carmine 3B, etc.

Specific examples of the violet pigments include Fast Violet B, Methyl Violet Lake, etc.

Specific examples of the blue pigments include cobalt blue, Alkali Blue, Victoria Blue Lake, Phthalocyanine Blue, metal-free Phthalocyanine Blue, partially chlorinated Phthalocyanine Blue, Fast Sky Blue, Indanthrene Blue BC, etc.

Specific examples of the green pigments include a chrome green, chrome oxide, Pigment Green B, Malachite Green Lake, etc.

Specific examples of the black pigments include azine pigments such as carbon black, oil furnace black, channel black, lamp black, acetylene black and aniline black, metal salts of azo pigments, metal oxides, complex metal oxides, etc.

These pigments are used alone or in combination.

The toner of the present invention preferably includes the pigment in an amount of from 4 to 16% by weight, and more preferably from 7 to 14% by weight. The pigment may be combined with a resin to form a masterbatch.

The toner of the present invention can include a charge controlling agent, an inorganic particulate material, a fluidity improver, a cleanability improver, a magnetic material, a metal soap, etc. when necessary besides the binder resin, the release agent and the pigment.

Specific examples of the charge controlling agents include Nigrosin; azine dyes including an alkyl group having 2 to 16 carbon atoms disclosed in Japanese Patent Publication No. 42-1627; basic dyes (e.g. C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (CI. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), Basic Blue 26 (C.I. 44045), C.I. Basic Green 1 (C.I. 42040) and C.I. Basic Green 4 (C.I. 42000)); lake pigments of these basic dyes; C.I. Solvent Black 8 (C.I. 26150); quaternary ammonium salts such as benzoylhexadecylammonium chlorides and decyltrimethyl chlorides; dialkyl tin compounds such as dibuthyl or dioctyl tin compounds; dialkyl tin borate compounds; guanidine derivatives; vinyl polymers including amino groups, polyamine resins such as condensation polymers including an amino group, metal complexes of mono azo dyes disclosed in Japanese Patent Publications Nos. 41-20153, 43-27596, 44-6397 and 45-26478; metal complexes of dicarboxylic acid such as Zn, Al, Co, Cr, and Fe complexes of salicylic acid, dialkylsalicyic acid and naphtoic acid; sulfonated copper phthalocyanine pigments, organic boric salts, quaternary ammonium salts including a fluorine atom, calixarene compounds, etc.

Marketed charge controlling agents can also be used. Specific examples of the marketed charge controlling agents include BONTRON P-51 (quaternary ammonium salt), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, a quaternary ammonium group, etc.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 1 to 5 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner increases, resulting in deterioration of fluidity and decrease of image density.

Transferability and durability of the toner of the present invention are further improved by externally adding an inorganic particulate material such as silica, titanium oxide, alumina, silicon carbonate, silicon nitride and boron nitride and a particulate resin onto a mother toner particle of the toner. This is because these external additives cover a wax deteriorating the transferability and durability and a surface of the toner to decrease contact area thereof.

The inorganic particulate material is preferably hydrophobized, and a hydrophobized particulate material of metal oxide such as silica and titanium oxide are preferably used. The particulate resin such as particulate polymethylmethacrylate and polystyrene having an average particle diameter of from 0.05 to 1 μm, which are formed by a soap-free emulsifying polymerization method, are preferably used. Further, a toner including the hydrophobized silica and hydrophobized titanium oxide as external additives, wherein an amount of the hydrophobized silica is larger than that of the hydrophobized titanium oxide, has good charge stability against humidity.

A toner including the above-mentioned particulate inorganic material and external additives having a particle diameter larger than that of conventional external additives such as a silica having a specific surface area of from 20 to 50 $m^2/g$ and particulate resin having an average particle diameter of from 1/100 to 1/8 to that of the toner, has good durability. This is because it can be prevented that particulate metal oxide are buried into a mother toner particle by the external additives having a particle diameter larger than that of the particulate metal oxide, although the particulate metal oxide externally added to a toner tend to be buried into the mother toner particle while the toner is mixed and stirred with a carrier, and charged to develop an image in an image developer.

A toner internally including the particulate inorganic material and particulate resin has improved pulverizability as well as transferability and durability although being less than the toner externally including them. When the external and internal additives are used together, it can be prevented that the external additives are buried into the mother toner particle and the resultant toner stably has good transferability and durability.

Specific examples of the hydrophobizing agents include dimethyldichlorosilane, trimethylchlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxylsilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-tert-propylphenyl)-trichlorosilane, (4-tert-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-tert-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-tert-propylphenyl)-diethyl-chlorosilane, octyltrimethoxysilane, hexamethyldisilazane, hexaethyldisilazane, hexatolyldisilazane, etc. Besides these agents, titanate coupling agents and aluminium coupling agents can be used.

Besides, as an external additive for the purpose of improving cleanability, lubricants such as fine particles of aliphatic metallic salts and polyvinylidene fluoride can be used.

Methods of preparing the toner of the present invention are not particularly limited, and known methods such as a melting and kneading pulverization method; a polymerization method (a suspension polymerization method and an emulsion polymerization method); a polyaddition reaction method using a prepolymer including an isocyanate group; a method of solving with a solvent, removing the solvent and pulverizing; and a melting spray method can be used. Among these methods, the melting and kneading pulverization method is preferably used.

The melting and kneading pulverization method includes melting, kneading, pulverizing and classifying toner materials including at least the crystalline polyester resin, the amorphous resin, the colorant and the release agent to form a toner. First the toner materials are mixed to prepare a mixture and the mixture is kneaded upon application of heat in a kneader. Suitable kneaders include the kneaders include single-axis or double-axis continuous kneaders and batch kneaders such as roll mills. Specific examples of the kneaders include KTK double-axis extruders manufactured by Kobe Steel, Ltd., TEM extruders manufactured by Toshiba Machine Co., Ltd., double-axis extruders manufactured by KCK Co., Ltd., PCM double-axis extruders manufactured by Ikegai Corp., and KO-KNEADER manufactured by Buss AG In the kneading process, it is preferable to control the kneading conditions so as not to cut molecular chains of the binder resin in the toner. Specifically, when the mixture is kneaded at a temperature too lower than a softening point of the binder resin, the molecular chains of the binder resin tend to cut. When the kneading temperature is too high, the mixture cannot be fully dispersed.

In the pulverizing process, it is preferable that the kneaded mixture is at first crushed to prepare coarse particles and then the coarse particles are pulverized to prepare fine particles. In the pulverizing step, a method of crashing the coarse particles against a collision plate by jet air or a method of passing the coarse particles through a narrow gap between a mechanically rotating rotor and a stator is preferably used.

In the classifying process, the pulverized mixture is classified into particles having a predetermined particle diameter. The classification is made by cyclone, decanter and centrifugal separation, etc. to remove microscopic particles.

After the microscopic particles are removed, pulverized mixture is further air-classified by a centrifugal force to prepare a parent toner having a predetermined particle diameter.

In order to improve fluidity, preservability, developability and transferability of the toner, the thus prepared parent toner can be mixed with an inorganic particulate material (external additive). Suitable mixers for use in mixing the mother toner particles and an external additive include known mixers for mixing powders, which preferably have a jacket to control the inside temperature thereof. By changing the timing when the external additive is added or the addition speed of the external additive, the stress on the external additive can be changed. Of course, by changing rotating number of the blade of the mixer used, mixing time, mixing temperature, etc., the stress can also be changed. In addition, a mixing method in which at first a relatively high stress is applied and then a relatively low stress is applied to the external additive, or vice versa, can also be used. Specific examples of the mixers include V-form mixers, locking mixers, Loedge Mixers, NAUTER MIXERS, HENSCHEL MIXERS and the like mixers. Then, coarse particles and aggregation particles are removed from a coarse toner through a sieve having 250 meshes or more to prepare a toner.

The toner preferably has a volume-average particle diameter of from 4 to 10 μm, and more preferably from 5 to 10 μm. In addition, the toner preferably has a ratio of the volume-average particle diameter to a number-average particle diameter of from 1.00 to 1.40, and more preferably from 1.10 to 1.25.

The volume-average particle diameter and the number-average diameter are measured by Coulter Counter TA-II from Coulter Electronics, Inc.

The toner the present invention is preferably a color toner selected from the group consisting of black toners, cyan toners, magenta toners and yellow toners. The color toners include the pigments mentioned above.

The developer of the present invention includes the toner of the present invention and may further includes components such as a carrier, and can be used as a one-component developer formed of a toner or a two-component developer formed of a toner and a carrier. The two-component developer is preferably used for high-speed printers in compliance with improvement of information process speed in terms of life improvement.

The carrier is not particularly limited, and can be selected in accordance with the purpose, however, preferably includes a core material and a resin layer coating the core material.

The core material is not particularly limited, and can be selected from known materials such as Mn—Sr materials and Mn—Mg materials having 50 to 90 emu/g; and highly magnetized materials such as iron powders having not less than 100 emu/g and magnetite having 75 to 120 emu/g for image density. In addition, light magnetized materials such as Cu—Zn materials having 30 to 80 emu/g are preferably used to decrease a stress to a photoreceptor having toner ears for high-quality images. These can be used alone or in combination.

The core material preferably has a volume-average particle diameter (D50) of from 10 to 150 μm, and more preferably from 20 to 80 μm. When less than 10 μm, a magnetization per particle is so low that the carrier scatters. When larger than 150 μm, a specific surface area lowers and the toner occasionally scatters, and a solid image of a full-color image occasionally has poor reproducibility.

Specific examples of the resin coating the core material include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins. These can be used alone or in combination.

Specific examples of the amino resins include urea-formaldehyde resins, melamine resins, benzoguanamine resins, urea resins, polyamide resins, epoxy resins, etc. Specific examples of the polyvinyl resins include acrylic resins, polymethylmethacrylate resins, polyacrylonitirile resins, polyvinyl acetate resins, polyvinyl alcohol resins, polyvinyl butyral resins, etc. Specific examples of the polystyrene resins include polystyrene resins, styrene-acrylic copolymers, etc. Specific examples of the halogenated olefin resins include polyvinyl chloride resins, etc. Specific examples of the polyester resins include polyethyleneterephthalate resins, polybutyleneterephthalate resins, etc.

An electroconductive powder may optionally be included in the toner. Specific examples of such electroconductive powders include, but are not limited to, metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The resin layer can be formed by preparing a coating liquid including a solvent and, e.g., the silicone resin; uniformly coating the liquid on the surface of the core material by a known coating method; and drying the liquid and burning the surface thereof. The coating method includes dip coating methods, spray coating methods, brush coating method, etc.

Specific examples of the solvent include, but are not limited to, toluene, xylene, methyl ethyl ketone, methyl isobutyl ketone, cellosolve butyl acetate, etc. Specific examples of the burning methods include, but are not limited to, externally heating methods or internally heating methods using fixed electric ovens, fluidized electric ovens, rotary electric ovens, burner ovens, microwaves, etc.

The carrier preferably includes the resin layer in an amount of from 0.01 to 5.0% by weight. When less than 0.01% by weight, a uniform resin layer cannot be formed on the core material. When greater than 5.0% by weight, the resin layer becomes so thick that carrier particles granulate one another and uniform carrier particles cannot be formed.

The content of the carrier in a two-component developer is not particularly limited, can be selected in accordance with the purpose, and is preferably from 90 to 98% by weight, and more preferably from 93 to 97% by weight.

The two-component developer typically includes a toner in an amount of from 1 to 10 parts by weight per 100 parts by weight of the carrier.

The developer of the present invention including a toner maintaining good transferability and cleanability for long periods without uneven image density and burial of an external additive when the developer is stirred, and having good stability, i.e., less variation of fluidity and chargeability for long periods, stably produce clear high-quality images.

The developer of the present invention can preferably be used in known electrophotographic image forming methods such as magnetic one-component developing methods, non-magnetic one-component developing methods and two-component developing methods. In addition, the developer of the present invention can preferably be used in the following toner container, process cartridge, image forming apparatus and image forming method.

The toner container includes the toner of the present invention or a premix agent which is a mixture of the toner and the carrier.

The container is not particularly limited and can be selected from known containers, and containers having a cap are preferably used. The container may have a size, a shape, a structure, a material, etc. in accordance with the purposes.

The container preferably has a cylindrical shape and spiral concavities and convexities on the inner circumferential face, and a part or all of which are accordion. Such a container transfers a toner therein to a discharge outlet thereof when rotated. The container is preferably formed of a material having good size preciseness, such as a polyester resin, polyethylene, polypropylene, polystyrene, polyvinylchloride, polyacrylate, a polycarbonate resin, an ABS resin and polyacetal resin.

The toner container of the present invention is easy to store, transport and handle, and detachable from a process cartridge and an image forming apparatus to feed a developer thereto.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation Example 1

Synthesis of Organic Particulate Emulsion 650 parts of water, 10 parts of a sodium salt of an adduct of a sulfuric ester with ethyleneoxide methacrylate (ELEMINOL RS-30 from Sanyo Chemical Industries, Ltd.), 130 parts of styrene, 130 parts of methacrylate and 1.4 part of persulfate ammonium were mixed in a reaction vessel including a stirrer and a thermometer, and the mixture was stirred for 25 min at 500 rpm to prepare a white emulsion therein. The white emulsion was heated to have a temperature of 75° C. and reacted for 5 hrs. Further, 40 parts of an aqueous solution of persulfate ammonium having a concentration of 1% were added thereto and the mixture was left for 10 hrs at 80° C. to prepare a [particulate dispersion 1] of a vinyl resin (a copolymer of a sodium salt of an adduct of styrene-methacrylate-butylacrylate-sulfuric ester with ethyleneoxide methacrylate).

The [particulate dispersion 1] had a volume-average particle diameter of 0.28 μm when measured by LA-920. The [particulate dispersion 1] was partially dried to isolate a resin. The resin had a Tg of 156° C.

Preparation Example 2

Preparation for Aqueous Phase 1,000 parts of water, 90 parts of the [particulate dispersion 1], 50 parts of an aqueous solution of sodium dodecyldiphenyletherdisulfonate having a concentration of 50% (ELEMINOL MON-7 from Sanyo Chemical Industries, Ltd.) and 90 parts of ethyl acetate were mixed and stirred to prepare an [aqueous phase 1].

Preparation Example 3

Synthesis of Low-Molecular-Weight Polyester<Polyester Having Hydroxyl Group>

235 parts of an adduct of bisphenol A with 2 moles of ethyleneoxide, 535 parts of an adduct of bisphenol A with 3 moles of propyleneoxide, 215 parts terephthalic acid, 50 parts of adipic acid and 3 parts of dibutyltinoxide were polycondensed in a reactor vessel including a cooling pipe, a stirrer and a nitrogen inlet pipe for 10 hrs at a normal pressure and 240° C. Further, after the mixture was depressurized by 10 to 20 mm Hg and reacted for 6 hrs, 45 parts of trimellitic acid anhydride were added thereto and the mixture was reacted for 3 hrs at a normal pressure and 185° C. to prepare a [low-molecular-weight polyester 1] having a number-average molecular weight of 2,800, a weight-average molecular weight of 7,100, a Tg of 45° C. and an acid value of 22 KOH mg/g.

Preparation Example 4

Synthesis of Intermediate Polyester 700 parts of an adduct of bisphenol A with 2 moles of ethyleneoxide, 85 parts of an adduct of bisphenol A with 2 moles of propyleneoxide, 300 parts terephthalic acid, 25 parts of trimellitic acid anhydride and 3 parts of dibutyltinoxide were mixed and reacted in a reactor vessel including a cooling pipe, a stirrer and a nitrogen inlet pipe for 10 hrs at a normal pressure and 240° C. Further, after the mixture was depressurized to 10 to 20 mm Hg and reacted for 6 hrs to prepare an [intermediate polyester 1] having a number-average molecular weight of 2,500, a weight-average molecular weight of 10,000, a Tg of 58° C., an acid value of 0.5 and a hydroxyl value of 52.

(Synthesis of Polyester Prepolymer Having Isocyanate Group)

Next, 400 parts of the [intermediate polyester 1], 90 parts of isophoronediisocyanate and 500 parts of ethyl acetate were reacted in a reactor vessel including a cooling pipe, a stirrer and a nitrogen inlet pipe for 6 hrs at 100° C. to prepare a [prepolymer 1]. The [prepolymer 1] included a free isocyanate in an amount of 1.67% by weight.

Preparation Example 5-1

Synthesis of Crystalline Polyester 28 moles of 1,4-butanediol, 24 moles of fumaric acid, 1.80 moles of trimellitic acid anhydride and 6.0 g of hydroquinone were reacted in a reactor vessel including a cooling pipe, a stirrer and a nitrogen inlet pipe at 150° C. for 4 hrs, 200° C. for 0.5 hrs, and further at 8.5 KPa for 0.5 hrs to prepare a [crystalline polyester resin 1] having a softening point and a melting point (DSC endothermic peak temperature) of 80° C., a Mn of 600, a Mw of 1,500, an acid value of 24 and a hydroxyl value of 29.

Preparation Example 5-2

Synthesis of Crystalline Polyester 28 moles of 1,4-butanediol, 24 moles of fumaric acid, 1.80 moles of trimellitic acid anhydride and 6.0 g of hydroquinone were reacted in a reactor vessel including a cooling pipe, a stirrer and a nitrogen inlet pipe at 150° C. for 8 hrs, 200° C. for 2 hrs, and further at 8.5 KPa for 2 hrs to prepare a [crystalline polyester resin 2] having a softening point and a melting point (DSC endothermic peak temperature) of 130° C., a Mn of 800, a Mw of 3,000, an acid value of 26 and a hydroxyl value of 30.

Preparation Example 6

Synthesis of Ketimine 180 parts of isophoronediamine and 80 parts of methyl ethyl ketone were reacted at 50° for 6 hrs in a reaction vessel including a stirrer and a thermometer to prepare a [ketimine compound 1]. The [ketimine compound 1] had an amine value of 420.

Preparation Example 7

Synthesis of Masterbatch<MB>

1,300) parts of water, 550 parts of carbon black Printex 35 from Degussa A.G. having a DBP oil absorption of 43 ml/100 mg and a pH of 9.5, 1,300 parts of a polyester resin were mixed by a Henschel Mixer from Mitsui Mining Co., Ltd. After the mixture was kneaded by a two-roll mill having a surface temperature of 160° C. for 45 min, the mixture was extended by applying pressure, cooled and pulverized by a pulverizer to prepare a [masterbatch 1].

Preparation Example 8

Preparation of Oil Phase<Pigment and Wax Dispersion 1>

400 parts of the [low-molecular-weight polyester 1], 100 parts of a microcrystalline wax having an acid value of 0.1 KOH mg/g and a melting point of 70° C., 20 parts of a charge controlling agent (salicylic acid metal complex E-84 from Orient Chemical Industries, Ltd.) and 1,000 parts of ethyl acetate were mixed in a reaction vessel including a stirrer and a thermometer. The mixture was heated to have a temperature of 80° C. while stirred. After the temperature of 80° C. was maintained for 8 hrs, the mixture was cooled to have a temperature of 24° C. in an hour. Then, 480 parts of the [masterbatch 1] and 550 parts of ethyl acetate were added to the mixture and mixed for 1 hr to prepare a [material solution 1].

The [material solution 1] were transferred into another vessel, and the carbon black and wax therein were dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,000 parts of an ethyl acetate solution of the [low-molecular-weight polyester 1] having a concentration of 65% were added to the [material solution 1] and the mixture was stirred by the beads mill for 1 pass under the same conditions to prepare a [pigment and wax dispersion liquid 1] having a solid concentration of 53% (130° C., 30 min).

Preparation Example 9

Preparation of Oil Phase<Pigment and Wax Dispersion 2>

The procedure for preparation of the pigment and wax dispersion 1 was repeated except for replacing the microcrystalline wax with a microcrystalline wax having an acid value of 0.2 KOH mg/g and a melting point of 150° C.

Preparation Example 10-1

Preparation of Crystalline Polyester Dispersion 110 g of the [crystalline polyester resin 1] and 450 g of ethylacetate were placed in a metallic container having a capacity of 21, and heated to dissolve or disperse at 80° C. and quickly cooled in iced water to prepare a mixture. 500 ml of glass beads having a diameter of 3 mm were added therein and the mixture was stirred by a batch sand mill from Kanpe Hapio Co., Ltd. for 10 hrs to prepare a [crystalline polyester dispersion 1].

Preparation Example 10-2

Preparation of Crystalline Polyester Dispersion 110 g of the [crystalline polyester resin 2] and 450 g of ethylacetate were placed in a metallic container having a capacity of 21, and heated to dissolve or disperse at 80° C. and quickly cooled in iced water to prepare a mixture. 500 ml of glass beads having a diameter of 3 mm were added therein and the mixture was stirred by a batch sand mill from Kanpe Hapio Co., Ltd. for 10 hrs to prepare a [crystalline polyester dispersion 2].

Example 1

Emulsification 700 parts of the [pigment and wax dispersion liquid 1], 120 parts of the [prepolymer 1], 80 of the [crystalline polyester dispersion 1] and 5 parts of the [ketimine compound 1] were mixed in a vessel by a TK homomixer from Tokushu Kika Kogyo Co., Ltd. at 6,000 rpm for 1 min. 1,300 parts of the [aqueous phase 1] were added to the mixture and mixed by the TK homomixer at 13,000 rpm for 20 min to prepare an [emulsified slurry 1].

De-Solvent

The [emulsified slurry 1] was placed in a vessel including a stirrer and a thermometer, a solvent was removed therefrom at 30° C. for 10 hrs and the slurry was aged at 45° C. for 5 hrs to prepare a [dispersion slurry 1].

(Wash and Dry)

After 100 parts of the [dispersion slurry 1] was filtered under reduced pressure to prepare a filtered cake, (1) 100 parts of ion-exchanged water were added to the filtered cake and mixed by the TK-type homomixer at 12,000 rpm for 10 min, and the mixture was filtered.

(2) Further, 100 parts of an aqueous solution of 10% sodium hydrate were added to the filtered cake and mixed by the TK-type homomixer at 12,000 rpm for 30 and the mixture was filtered under reduced pressure.

(3) Further, 100 parts of 10% hydrochloric acid were added to the filtered cake and mixed by the TK-type homomixer at 12,000 rpm for 10 min, and the mixture was filtered.

(4) Further, 300 parts of ion-exchange water were added to the filtered cake and mixed by the TK-type homomixer at 12,000 rpm for 10 min, and the mixture was filtered. This operation was repeated again to prepare a filtered cake 1. The filtered cake 1 was dried by an air drier at 45° C. for 48 hrs and sieved by a mesh having an opening of 75 μm to prepare [mother toner particles 1].

The release agent in the [mother toner particles 1] had a dispersion diameter of 0.06 μm. The crystalline polyester in the [mother toner particles 1] had a longitudinal dispersion diameter of from 0.2 to 3.0 μm. The [mother toner particles 1] had a volume-average particle diameter (Dv) not less than 3.0 μ and less than 6.0 and a ratio (Dv/Dn) of the volume-average particle diameter (Dv) to a number-average particle diameter (Dn) of from 1.05 to 1.25.

Example 2

The procedure for preparation of the [mother toner particles 1] in Example 1 was repeated to prepare a [mother toner particles 2] except for changing the emulsification process as follows.

700 parts of the [pigment and wax dispersion liquid 1], 120 parts of the [prepolymer 1], 70 of the [crystalline polyester dispersion 1] and 5 parts of the [ketimine compound 1] were mixed in a vessel by a TK homomixer from Tokushu Kika Kogyo Co., Ltd. at 7,000 rpm for 2 min. 1,300 parts of the [aqueous phase 1] were added to the mixture and mixed by the TK homomixer at 15,000 rpm for 30 min.

The release agent in the [mother toner particles 2] had a dispersion diameter of 0.07 μm. The crystalline polyester in the [mother toner particles 2] had a longitudinal dispersion diameter of from 0.2 to 1.5 μm. The [mother toner particles 2] had a volume-average particle diameter (Dv) not less than 3.0 μm and less than 6.0 μm, and a ratio (Dv/Dn) of the volume-average particle diameter (Dv) to a number-average particle diameter (Dn) of from 1.05 to 1.25.

Example 3

The procedure for preparation of the [mother toner particles 1] in Example 1 was repeated to prepare a [mother toner particles 3] except for replacing the [crystalline polyester dispersion 1] with the [crystalline polyester dispersion 2]. The release agent in the [mother toner particles 3] had a dispersion diameter of 0.08 μm. The crystalline polyester in the [mother toner particles 3] had a longitudinal dispersion diameter of from 0.2 to 3.0 μm. The [mother toner particles 3] had a volume-average particle diameter (Dv) not less than 3.0 μm and less than 6.0 μm, and a ratio (Dv/Dn) of the volume-average particle diameter (Dv) to a number-average particle diameter (Dn) of from 1.05 to 1.25.

Example 4

The procedure for preparation of the [mother toner particles 1] in Example 1 was repeated to prepare a [mother toner particles 4] except for replacing the [pigment and wax dispersion 1] with the [pigment and wax dispersion 2]. The release agent in the [mother toner particles 4] had a dispersion diameter of 0.09 μm. The crystalline polyester in the [mother toner particles 4] had a longitudinal dispersion diameter of from 0.2 to 3.0 μm. The [mother toner particles 4] had a volume-average particle diameter (Dv) not less than 3.0 μm and less than 6.0 μm, and a ratio (Dv/Dn) of the volume-average particle diameter (Dv) to a number-average particle diameter (Dn) of from 1.05 to 1.25.

Example 5

The evaluation of the resultant toner from Example 1 mentioned later was repeated except for using a modified Pro 901 having a system linear speed of 400 mm/sec from Ricoh Company, Ltd.

Example 6

The evaluation mentioned later of the resultant toner from Example 2 was repeated except for using a modified Pro 901 having a system linear speed of 400 mm/sec from Ricoh Company, Ltd.

Example 7

The evaluation mentioned later of the resultant toner from Example 3 was repeated except for using a modified Pro 901 having a system linear speed of 400 mm/sec from Ricoh Company, Ltd.

Example 8

The evaluation mentioned later of the resultant toner from Example 4 was repeated except for using a modified Pro 901 having a system linear speed of 400 mm/sec from Ricoh Company, Ltd.

Comparative Example 1

The procedure for preparation of the [mother toner particles 1] in Example 1 was repeated to prepare a [mother toner particles 5] except for changing the emulsification process as follows.

700 parts of the [pigment and wax dispersion liquid 1], 120 parts of the [prepolymer 1], 90 of the [crystalline polyester dispersion 1] and 5 parts of the [ketimine compound 1] were mixed in a vessel by a TK homomixer from Tokushu Kika Kogyo Co., Ltd. at 4,000 rpm for 0.5 min. 1,300 parts of the [aqueous phase 1] were added to the mixture and mixed by the TK homomixer at 11,000 rpm for 10 min.

The release agent in the [mother toner particles 5] had a dispersion diameter of 0.07 μm. The crystalline polyester in the [mother toner particles 2] had a longitudinal dispersion diameter of from 3.0 to 3.5 μm. The [mother toner particles 5] had a volume-average particle diameter (Dv) not less than 3.0 μm and less than 6.0 μm, and a ratio (Dv/Dn) of the volume-average particle diameter (Dv) to a number-average particle diameter (Dn) of from 1.05 to 1.25.

Comparative Example 2

The procedure for preparation of the [mother toner particles 1] in Example 1 was repeated to prepare a [mother toner particles 6] except for changing the emulsification process as follows.

700 parts of the [pigment and wax dispersion liquid 1], 120 parts of the [prepolymer 1], 65 of the [crystalline polyester dispersion 1] and 5 parts of the [ketimine compound 1] were mixed in a vessel by a TK homomixer from Tokushu Kika Kogyo Co., Ltd. at 8,000 rpm for 3 min. 1,300 parts of the [aqueous phase 1] were added to the mixture and mixed by the TK homomixer at 17,000 rpm for 45 min.

The release agent in the [mother toner particles 6] had a dispersion diameter of 0.07 μm. The crystalline polyester in the [mother toner particles 6] had a longitudinal dispersion diameter of from 3.0 to 6.0 μm. The [mother toner particles 6] had a volume-average particle diameter (Dv) not less than 3.0 μm and less than 6.0 μm, and a ratio (Dv/Dn) of the volume-average particle diameter (Dv) to a number-average particle diameter (Dn) of from 1.05 to 1.25.

Comparative Example 3

The evaluation mentioned later of the resultant toner from Comparative Example 1 was repeated except for using a modified Pro 901 having a system linear speed of 400 mm/sec from Ricoh Company, Ltd.

Comparative Example 4

The evaluation mentioned later of the resultant toner from Comparative Example 2 was repeated except for using a modified Pro 901 having a system linear speed of 400 mm/sec from Ricoh Company, Ltd.

0.7 parts of hydrophobic silica and 0.3 parts of hydrophobic titanium oxide were mixed with 100 parts of each of the mother toner particles 1 to 6 by HENSCHEL MIXER from Mitsui Mining Co., Ltd. to prepare a toner.

<Preparation of Carrier>

The following materials were dispersed by a homomixer for 10 min to prepare a liquid solution for forming a silicone-resin coated film. The liquid solution for forming a silicone-resin coated film was coated and dried on a calcined ferrite powder having a weight-average particle diameter of 70 nm by SPIRA COTA, in which the temperature was 40° C., from OKADA SEIKO CO., LTD. The resultant carrier was calcined in an electric oven at 300° C. for 1 hr. After cooled, the carrier was sieved through openings of 125 μm.

| | |
|---|---|
| Silicone resin solution SR2410 including a solid content of 23% from Dow Corning Toray Silicone Co., Ltd. | 132.2 |
| Amino silane SH6020 including a solid content of 100% from Dow Corning Toray Silicone Co., Ltd. | 0.66 |
| Electroconductive particulate material surface-treated double-layered alumina including an under layer formed of tin dioxide and an upper layer formed of indium oxide including tin dioxide, and having an average particle diameter of 0.35 μm and a particulate powder specific resistivity of 3.5 Ω · cm | 31 |
| Toluene | 300 |

<Preparation of Developer>

8% by weight of each of the toners from Examples 1 to 4 and Comparative Examples 1 to 2 and 92% by weight of the carrier were mixed to prepare a two-component developer.

<Evaluation of Preciseness of Controlling Toner Concentration>

Each of the developers was used in a modified image forming apparatus Pro901 having a system linear speed of 1,700 mm/sec from Ricoh Company, Ltd. to produce A4 size chart images having an image area of 5%. Every 100,000 images, a deviation between the toner concentration (detected toner concentration) determined from the output voltage Vt of the toner concentration sensor and the actually-measured toner concentration was measured. The actually-measured toner concentration was measured by the known blow-off method.

The preciseness of controlling toner concentration of each of the developers was evaluated under the following deviation standard.

Excellent: not greater than 0.2%

Good: greater than 0.2% and not greater than 0.5%

Fair: greater than 0.5% and not greater than 1.0%

Poor: greater than 1.0%

Figure 4:
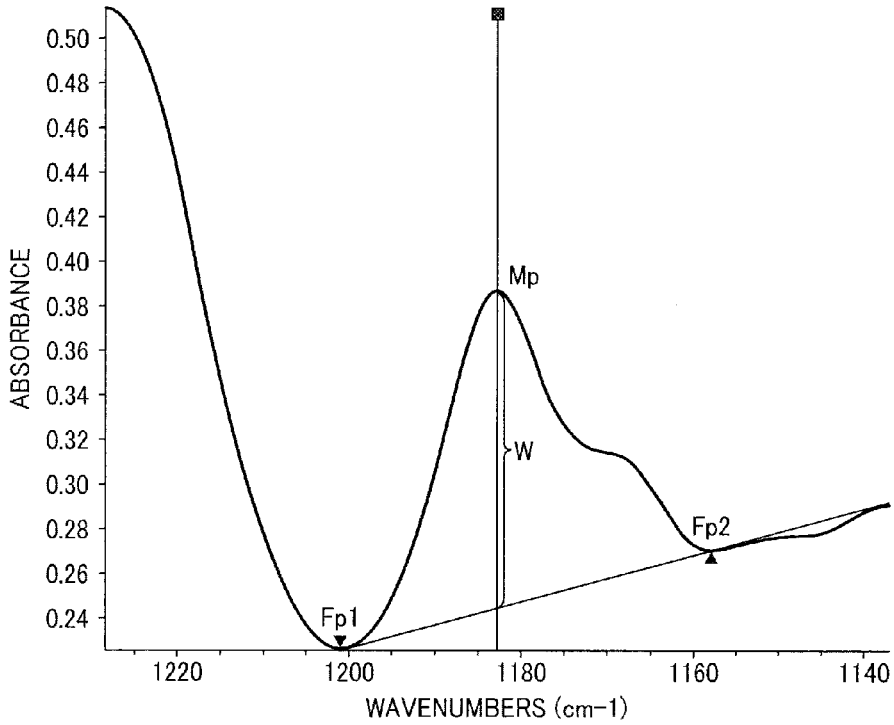
FIG. 4 is a diagram showing an example of an infrared absorption spectrum of a crystalline polyester resin.

FIG. 4 is a diagram showing an example of an infrared absorption spectrum of a crystalline polyester resin.

As FIG. 4 shows, the infrared absorption spectrum of a crystalline polyester resin has a falling peak at which the absorbance becomes small first (hereinafter referred to as a "first falling peak Fp1".), another falling peak at which the absorbance becomes small secondly (hereinafter referred to as a "second falling peak Fp2".) and a rising peak Mp at which the absorbance becomes maximum therebetween in a wavelength of from 1130 $cm^{-1}$ to 1220 $cm^{-1}$. A line from the first falling peak Fp1 to the second falling peak Fp2 is a base line. A vertical line is drawn from the rising peak Mp toward the horizontal axis, and an absolute value of a difference between the absorbance at an intersection with the base line and the absorbance at the rising peak Mp is a height W thereof.

Figure 5:
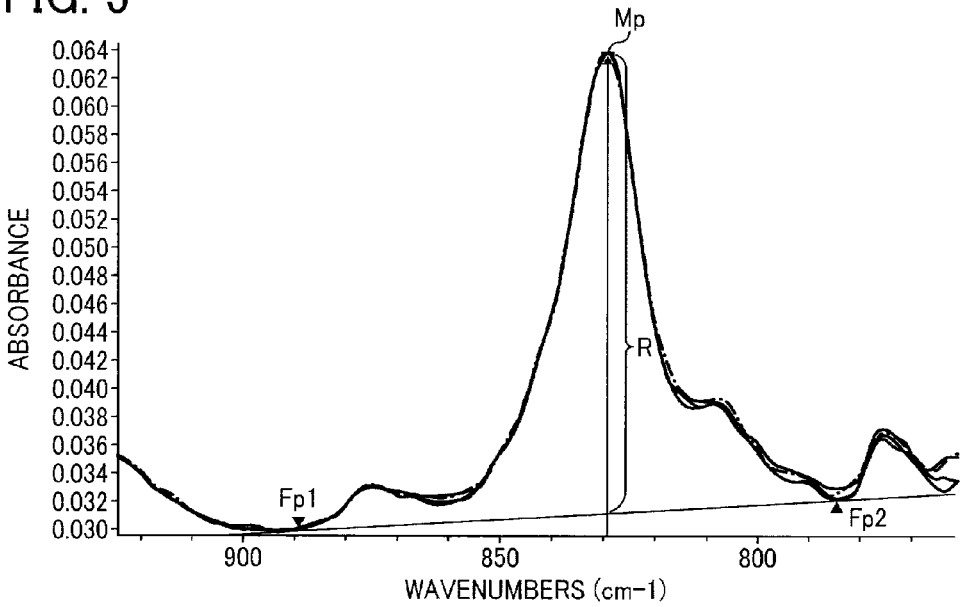
FIG. 5 is a diagram showing an example of an infrared absorption spectrum of an amorphous polyester resin.

FIG. 5 is a diagram showing an example of an infrared absorption spectrum of an amorphous polyester resin.

As FIG. 5 shows, the infrared absorption spectrum of a crystalline polyester resin has a falling peak at which the absorbance becomes small first (hereinafter referred to as a "first falling peak Fp1".), another falling peak at which the absorbance becomes small secondly (hereinafter referred to as a "second falling peak Fp2".) and a rising peak Mp at which the absorbance becomes maximum therebetween in a wavelength of from 780 $cm^{-1}$ to 900 $cm^{-1}$. A line from the first falling peak Fp1 to the second falling peak Fp2 is a base line. A vertical line is drawn from the rising peak Mp toward the horizontal axis, and an absolute value of a difference between the absorbance at an intersection with the base line and the absorbance at the rising peak Mp is a height R thereof. W/R is a peak ratio.

A toner including a crystalline polyester resin and an amorphous polyester resin so as to have a peak ratio W/R less than 0.22 is short of the crystalline polyester resin, and a release agent is not sufficiently dispersed thereby in the toner. When the toner continuously receives a mechanical stress, the release agent is eccentrically located on the surface of the toner, resulting in agglutination thereof. It is thought the agglutination of the toner enlarges the deviation and deteriorates the preciseness of controlling toner concentration.

When a toner includes the crystalline polyester resin too much, the crystalline polyester resin contaminates a carrier or a photoreceptor, resulting in shorter lives thereof. However, in Examples 1 to 3, the contamination of the carrier or the

TABLE 1

| | System linear speed (mm/sec) | W/R | Softening point of crystalline polyester resin (° C.) | Tg (° C.) of crystalline polyester resin | Melting point of release agent (° C.) | Deviation |
|---|---|---|---|---|---|---|
| Example 1 | 1700 | 0.55 | 80 | 80 | 70 | Good |
| Example 2 | 1700 | 0.22 | 80 | 80 | 70 | Excellent |
| Example 3 | 1700 | 0.55 | 130 | 130 | 70 | Good |
| Example 4 | 1700 | 0.55 | 80 | 80 | 150 | Good |
| Example 5 | 400 | 0.55 | 80 | 80 | 70 | Excellent |
| Example 6 | 400 | 0.22 | 80 | 80 | 70 | Excellent |
| Example 7 | 400 | 0.55 | 130 | 130 | 70 | Excellent |
| Example 8 | 400 | 0.55 | 80 | 80 | 150 | Excellent |
| Comparative Example 1 | 1700 | 0.57 | 80 | 80 | 70 | Poor |
| Comparative Example 2 | 1700 | 0.20 | 80 | 80 | 70 | Poor |
| Comparative Example 3 | 400 | 0.57 | 80 | 80 | 70 | Poor |
| Comparative Example 4 | 400 | 0.20 | 80 | 80 | 70 | Poor |

photoreceptor with the crystalline polyester resin was not observed. Therefore, a toner including the crystalline polyester resin and the amorphous polyester resin so as to have a peak ratio W/R not greater than 0.55, the crystalline polyester resin does not contaminate the carrier or the photoreceptor and does not cause shorter lives thereof.

The toner of the present invention includes the crystalline polyester resin and the amorphous polyester resin as binder resins so as to have a peak ratio W/R of from 0.22 to 0.55. Instead of the amorphous polyester resin, other amorphous resins such as styrene-acrylic resins may be used. The styrene-acrylic resin has a maximum rising peak Mp of 699 $cm^{-1}$, and first falling peak Fp1 and a second falling peak Fp2 which is a base line, of 670 $cm^{-1}$ and 714 $cm^{-1}$, respectively.

The image forming apparatus of the present invention has a system speed of from 400 mm/sec to 1,700 mm/sec, develops a latent image borne on the surface of the photoreceptor 1 as a latent image bearer with a two-component developer including a toner and a carrier by the image developer 4 to form a toner image, and finally transfer the toner image on the photoreceptor 1 onto the sheet S as a recording material. The image forming apparatus includes the toner concentration sensor 29 as a toner concentration detector detecting a toner concentration of a two-component developer in the image developer 4, the toner feeder 5 feeding a toner into the image developer 4, the controller 35 controlling the toner feeder 5 such that the toner concentration of the two-component developer in the image developer 4 has a target concentration and the pattern image density sensor 34 as a toner adherence amount detector detecting a toner adherence amount of a toner patter image formed on the photoreceptor 1 or a toner patter image transferred from therefrom onto the transfer belt 32, and the controller 35 adjusts the target toner concentration, based on a detection result of the pattern image density sensor 34. The toner used in the image forming apparatus includes at least a release agent and a binder resin including a crystalline polyester resin and an amorphous polyester resin as an amorphous resin. When the crystalline polyester resin has a height W of a third falling peak Fp3 in an infrared absorption spectrum thereof obtained by IR spectroscopy (total reflection method) using a Fourier transform spectrometer and the amorphous polyester resin has a height R of a maximum rising peak Mp in an infrared absorption spectrum thereof obtained by IR spectroscopy, W/R is from 0.2 to 0.55. The crystalline polyester resin finely disperses the release agent (assists the release agent to disperse), and even when the toner continuously receives a mechanical stress, the crystalline polyester resin prevents the release agent from being eccentrically located on the surface of the toner. Consequently, deterioration of the toner concentration detection preciseness caused by toner agglutination occurable in high-speed image forming apparatus having a system speed of from 400 to 1,700 mm/sec is prevented, and production of abnormal images when the actual toner concentration has an abnormal value is prevented. When a toner includes the crystalline polyester resin too much, the crystalline polyester resin contaminates a carrier or a photoreceptor, resulting in shorter lives thereof, but the toner of the present invention does not cause their shorter lives.

The crystalline polyester resin typically has a softening point of from 80 to 130° C., and a glass transition temperature (Tg) of from 80 to 130° C. It is essential that the softening point $TF_{1/2}$ is from 80 to 130° C. When $TF_{1/2}$ is less than 80° C., the crystalline polyester resin exudes on the surface of the toner and the release agent is possibly difficult to disperse. When higher than 130° C., the crystalline polyester resin is difficult to exude on the surface of the toner and does not finely disperse the release agent (assist the release agent to disperse) sufficiently. In the present invention, the crystalline polyester resin present on the surface of the toner in a suitable amount finely disperse the release agent (assist the release agent to disperse) stably.

The softening point is measured by an elevated flow tester CFT-100 from Shimadzu Corp under the following conditions:

load: 10 kgs;
heating speed: 3° C./min;
die caliber: 1.0 mm; and
die length: 10 mm.

It is essential that a wax as the release agent has a melting point of from 70 to 150° C. When lower than 70° C., the wax tends to agglutinate and eccentrically be present on the surface of the toner. When higher than 150° C., the wax is difficult to exude on the surface of the toner and the toner possibly has insufficient releasability.

TG-DSC system TAS-100 from Rigaku Corp. is used to measure a melting point of the wax. First, about 10 mg of a sample in an aluminum container was loaded on a holder unit, which was set in an electric oven. After the sample was heated in the oven at from a room temperature to 180° C. at 10° C./min. The melting point is determined from a contact point between a tangent of a heat absorption curve and a base line using an analyzer of the TAS-100 system.

The wax is preferably at least one member selected from the group consisting of carnauba waxes, polyolefin waxes and synthetic ester waxes because of having a synergetic effect with the crystalline polyester resin and uniform dispersibility on the surface of a toner, and preventing the toner from agglutinating as time passes.

The present invention is applicable to a tandem image forming apparatus having plural photoreceptors bearing different color images each other and a direct transfer image forming apparatus directly transferring a toner image on a photoreceptor onto a sheet as well, besides the image forming apparatus explained herein.

The image forming apparatus of the present invention may form a toner pattern image on a transfer material such as a transfer belt as an image bearer and detect the toner pattern image density by the toner pattern image density sensor.

Having now fully described the invention, it will be apparent to one of ordinary skill in the art that many changes and modifications can be made thereto without departing from the spirit and scope of the invention as set forth therein.

What is claimed is:

1. An image forming apparatus having a system speed of from 400 to 1,700 mm/sec, comprising:

a latent image bearer configured to bear a latent image;

an image developer configured to develop the latent image with a two-component developer comprising a toner and a carrier to form a toner image; and a transferer configured to transfer the toner image onto a recording material, wherein the image forming apparatus further comprises:

a toner concentration detector configured to detect a toner concentration of the two-component developer in the image developer;

a toner feeder configured to feed the toner into the image developer; and a controller configured to control an amount of the toner fed by the toner feeder such that the toner concentration of the two-component developer in the image developer has a target toner concentration, and wherein the toner comprises a release agent and a binder resin comprising a crystalline polyester resin and an amorphous resin, wherein a ratio (W/R) of a maximum rising peak height (W) of the crystalline polyester resin to a maximum rising peak height (R) of the amorphous resin, which are observed respective infrared absorption spectra when measured by an IR spectroscopy (a total reflection method) using a Fourier transform infrared spectroanalyzer, is from 0.22 to 0.55.

2. The image forming apparatus of claim 1, wherein the crystalline polyester resin has a melting point of from 80 to 130° C. and a glass transition temperature of from 80 to 130° C.

3. The image forming apparatus of claim 1, wherein the release agent comprises a wax having a melting point of from 70 to 150° C.

4. The image forming apparatus of claim 3, wherein the wax is at least one member selected from the group consisting of carnauba waxes, polyolefin waxes and synthetic ester waxes.

5. An image forming method at a speed of 400 to 1,700 mm/sec, comprising:

developing a latent image on an image bearer by an image developer with a two-component developer comprising a toner and a carrier to form a toner image; and transferring the toner image onto a recording material, wherein the image forming method further comprises:

detecting a toner concentration of the two-component developer in the image developer;

feeding the toner into the image developer; and controlling an amount of the toner fed by the toner feeder such that the toner concentration of the two-component developer in the image developer has a target toner concentration, and wherein the toner comprises a release agent and a binder resin comprising a crystalline polyester resin and an amorphous resin, wherein a ratio (W/R) of a maximum rising peak height (W) of the crystalline polyester resin to a maximum rising peak height (R) of the amorphous resin, which are observed respective infrared absorption spectra when measured by an IR spectroscopy (a total reflection method) using a Fourier transform infrared spectroanalyzer, is from 0.22 to 0.55.

* * * * *